United States Patent [19]

Piazza et al.

[11] Patent Number: 4,725,214

[45] Date of Patent: Feb. 16, 1988

[54] APPARATUS FOR THE FABRICATION OF CONSTRUCTION BLOCKS

[76] Inventors: Giovanni Piazza, 27 rue Jules Guesdes, 59178 Hasnon; Mario Piazza, 15 rue Victor Hugo, 59135 Wallers, both of France

[21] Appl. No.: 842,262

[22] Filed: Mar. 21, 1986

[30] Foreign Application Priority Data

Apr. 16, 1985 [FR] France ..... 85 06086

[51] Int. Cl.[4] ..... B28B 7/16

[52] U.S. Cl. ..... 425/149; 425/412; 425/414; 425/454

[58] Field of Search ..... 425/406, 414, 415, 352, 425/443, 346, 261, 127, 330, 544, 557, 292, 454, 416, 544, 149; 149/157, 159, 89

[56] References Cited

U.S. PATENT DOCUMENTS 986,701 3/1911 Frerichs ..... 425/414

2,875,499 3/1959 Ross ..... 425/413

FOREIGN PATENT DOCUMENTS 0027376 4/1981 European Pat. Off. .

*Primary Examiner*—Jay H. Woo

*Assistant Examiner*—Karl D. Sturge

*Attorney, Agent, or Firm*—Kerkam, Stowell, Kondracki, & Clarke

[57] ABSTRACT

Apparatus for forming a constructional block in which a lower die is filled with a given and at least substantially excess amount of material after substantially closing the lower die with an upper die for forming a mold by drawing the dies together, the material is highly compressed while, simultaneously with drawing them together under the action of a means for controlling and regulating its passage, in a first stage, the excess material is allowed to escape partly outwardly of the mold and, in a second stage, substantially before obtaining the desired dimension between the two faces of the block through the relative drawing together of the dies, the passage of the material escaping outwardly of the mold is stopped.

3 Claims, 3 Drawing Figures

_FIG:1_
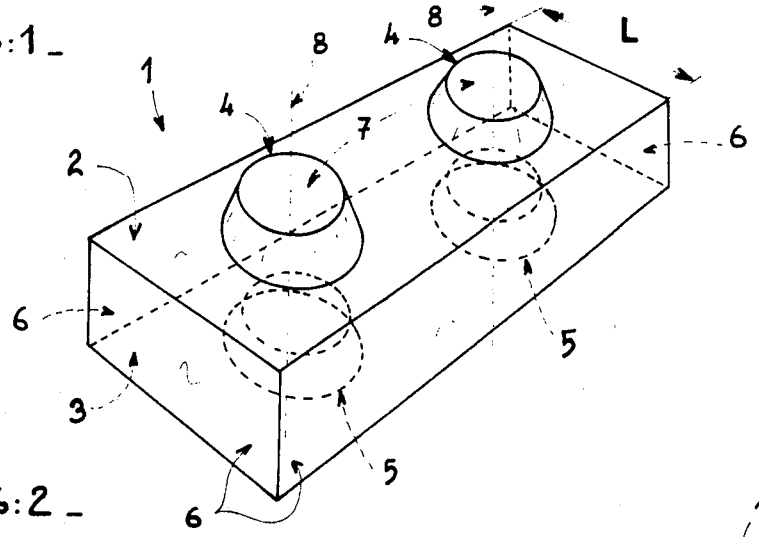
_FIG:2_
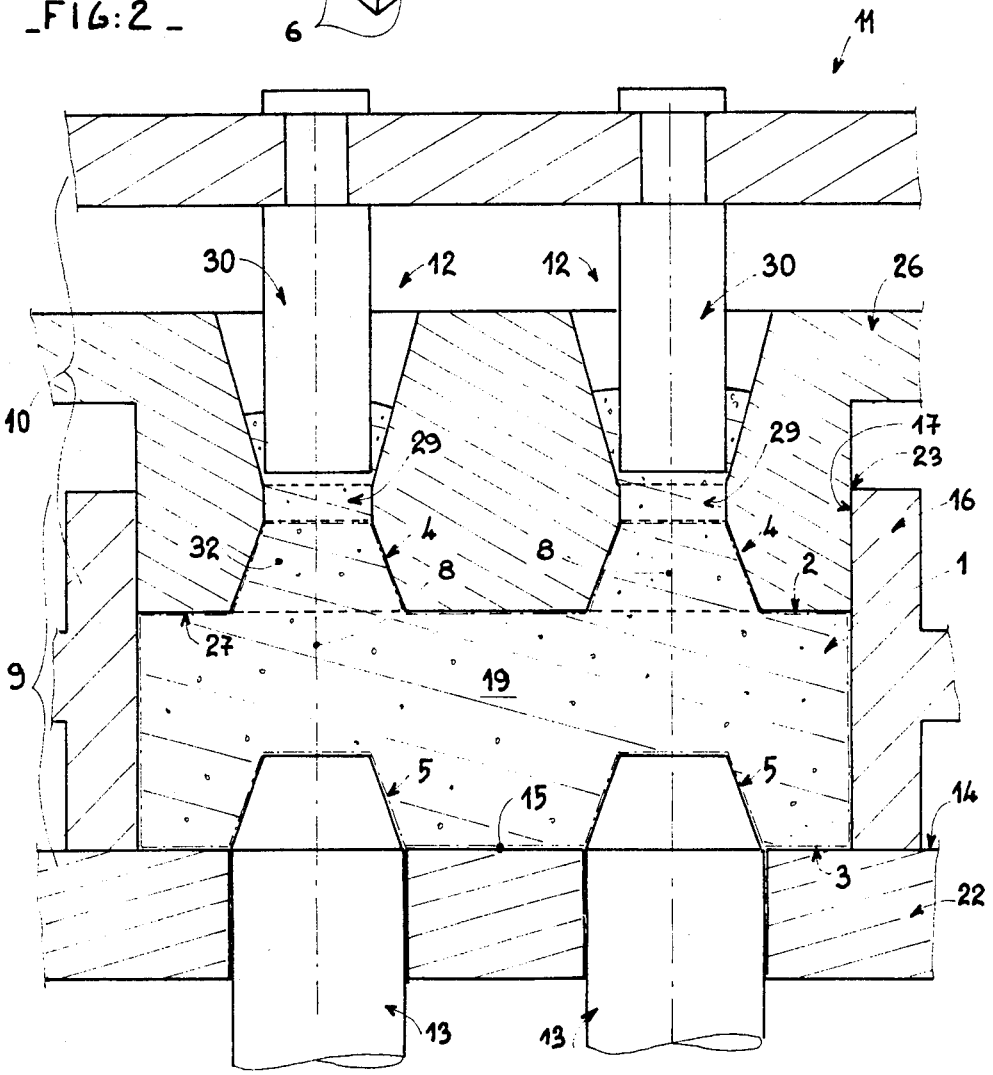

APPARATUS FOR THE FABRICATION OF CONSTRUCTION BLOCKS

The invention relates to a method of manufacturing constructional blocks, the means used for putting this method into practice and the product thus obtained.

It applies more particularly but not exclusively to the constructional blocks assembled by superimposition and preferably comprising on at least two of their parallel faces complementary means providing self positioning thereof when the blocks are assembled together.

In order to obtain constructional blocks easy to use, it is known to use blocks which are self positioned when they are placed on top of each other.

For providing self positioning thereof, such as it is known, the constructional blocks generally have a rectangular parallelepipedic shape and each have on at least two of their parallel faces means of complementary form.

Although numerous variants exist in these self positioning means, through their form and their arrangement, one of the faces of the block generally comprises one or more cavities whereas the face which is parallel thereto has, similarly arranged and preferably identically oriented, complementary ribs and/or bosses.

In the manufacture of such constructional blocks, a material in the plastic state and in an amount substantially equal to that of the volume to be filled is generally pressed in a mold.

A device is known more especially (patent No. EP-0027376) particularly adapted to the formation of constructional blocks provided with complementary self positioning means.

In this device, in an initial step, the imprint of a lower die is filled with a predetermined amount of material in the plastic state.

In the next compression step, the material is highly compressed by closing the lower die with an upper die.

Of course, the bottom of each lower and/or upper die is shaped so as to form one of the faces of the block equipped with complementary self positioning means.

It will be readily understood that, in this type of device, it is mainly the amount of material introduced into the mold which will determine the volume of the block obtained and consequently its thickness.

Thus, if it is desired to obtain constructional blocks of constant thickness, a device must necessarily be used for controlling the amount of material poured into the mold, which is reliable and accurate.

Because of the plastic state of the material and its lack of homogeneity, the feed control device raises problems of construction and, consequently, increases the cost of the installation.

A result which the invention desired to obtain is a method which, while allowing constructional blocks to be formed having self positioning means, guarantees a constant dimension at least between the faces of the block equipped with complementary self positioning means.

For this, the invention provides a method which is characterized in that:

the lower die is filled with a predetermined and at least substantially excess amount of material;

after substantially closing the lower die with the upper die so as to form the mold, by drawing said dies together the material is highly compressed while, sumultaneously with drawing them together, under the action of a means for controlling and regulating its passage, in a first step by slowing down its escape, the excess material is allowed at least partially to escape outwardly of the mold and, in a second stage, substantially before obtaining, through drawing the dies together relative to one another, the desired dimension between the two faces of the block equipped with self positioning means, the passage of the material escaping outwardly of the mold is stopped.

Which method is also characterized in that, after compressing the material:

the cores together forming the complementary means are retracted under the surface forming the bottom of the lower die, the die, the means for controlling and regulating the escape of the excess material, the frame forming the internal side walls of the lower die, and the block held between said side walls are raised simultaneously over a height at least greater than the total thickness of the block, in the following way, a mold stripping plate is brought substantially under the above assembly, the block is placed on the stripping plate while driving it out of the frame by means of the upper die which is lowered through the frame until it disengages this block, the stripping plate is removed and with it the block, the lower die is reformed by resting the frame on the surface forming the bottom of the lower die and erecting the cores above this surface, a new manufacturing cycle is begun again as required.

The invention also has as object the means for putting this method into practice as well as the constructional blocks thus obtained.

It will be better understood from the following description given by way of nonlimitative example with reference to the accompanying drawings which show schematically

BRIEF DESCRIPTION OF THE DRAWING

FIG. 1: a perspective view of the block obtained,

FIG. 2: a section of the mold during the step for compressing the material,

Figure 3:
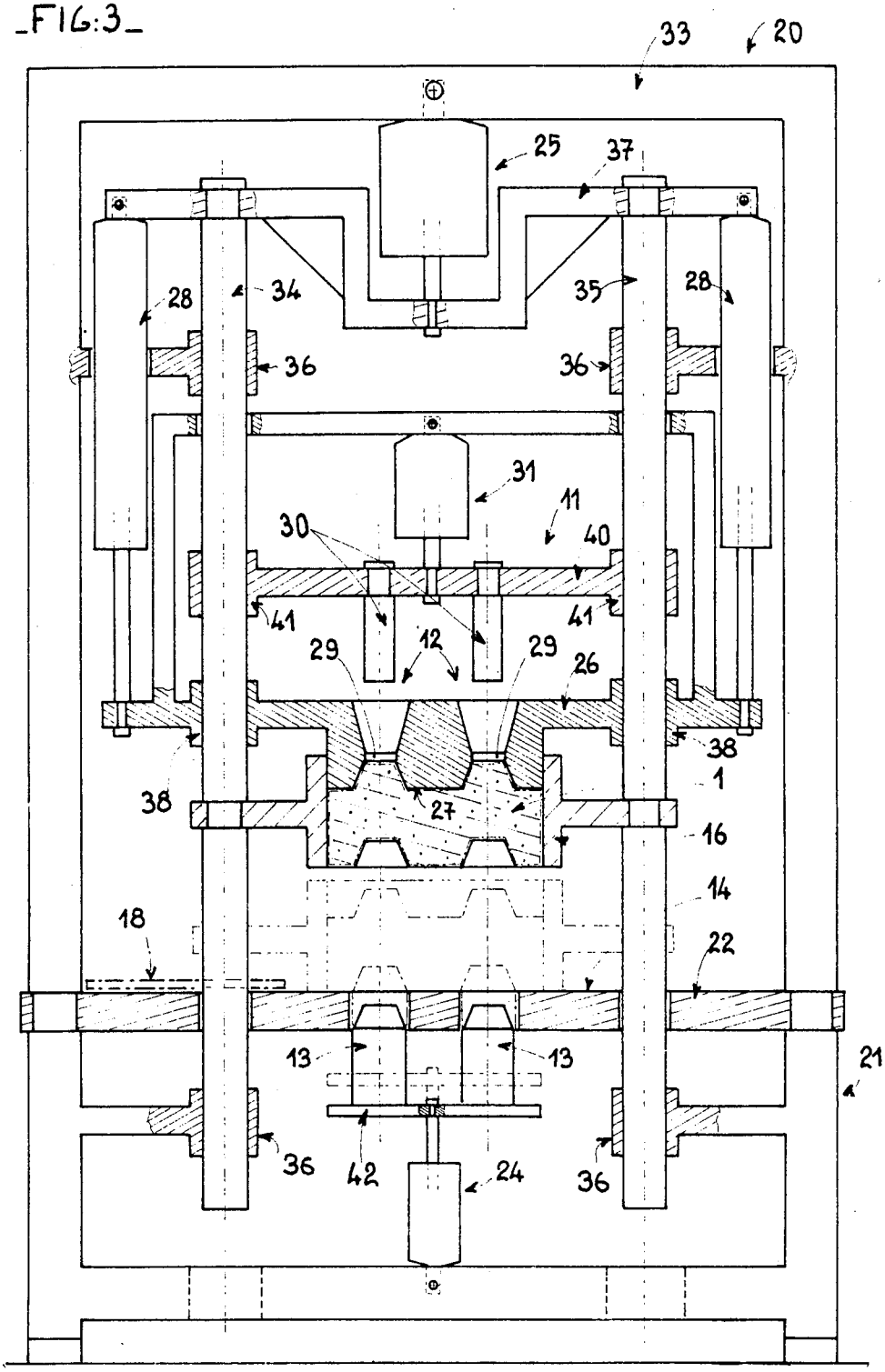
FIG. 3: a partial sectional view of the press equipped with the mold of the invention seen in an open position.

Referring to the drawings it can be seen that the constructional block 1 is formed of a right angle parallelepiped whose two parallel faces 2, 3 and preferably those providing the stablest support of the block, are provided with complementary means 4, 5 in the form of projections 4 and recesses 5 with respect to said faces 2, 3.

Without in any wise limiting the scope of the invention, in the example chosen for its qualities of robustness and simplicity, block proportions are given below which have provided good results.

The thickness between the faces 2, 3 provided with complementary means is substantially equal to half the width of the block.

So as to be able to connect two juxtaposed blocks either side by side or in the extension of each other, or disposed so as to form a right angle, the complementary means 4, 5 of the same nature are preferably two in number.

Advantageously, the two equipped faces 2, 3 have a length substantially equal to twice their width "L" and the complementary means 4, 5 are disposed at the intersection of the diagonals of each of the squares which may thus be inscribed on each face 2, 3.

In the example chosen, the complementary means 4, 5 when they project, have truncated cone shaped bosses 7 which, in a preferred embodiment, have a height substantially equal to a third of the width "L" of the block, with an angle at the apex of about 40° and a diameter at the base about half the width "L" of the block.

Of course, the bosses 7 may have other shapes and have for example the shape of a truncated pyramid.

The means 5 recessed in face 3 are preferably substantially identical and, if the blocks 1 are adapted for being assembled without sealing, the depth of the cavity which they each form is at least substantially equal to the height of the bosses.

Of course, considering the proportions given, it is desirable for the block to have dimensions such that it can be gripped manually.

However, it is not excluded to form larger blocks and, for example, corresponding to the juxtaposition both in the longitudinal direction and in the cross direction of several of the above described blocks and more particularly the transverse juxtaposition of the blocks so as to form an assembly comprising four bosses and four cavities.

Several blocks may be formed more particularly at the same time.

In the assemblies formed, so that the blocks 1 do not themselves generate defects of alignment, the complementary means 4 and 5 equipping each of the faces must be perfectly superimposed and for that are situated on the same axis perpendicular to the faces 2, 3 considered.

On the block shown in FIG. 1 two means 4, two means 5 and two axes 8 can be seen each comprising a paired and superimposed means 4 and a means 5.

For forming a block of this type, it is clear, that, in accordance with the invention, a lower die is filled with a given and at least substantially excess amount of material, after substantially closing the lower die 9 with the upper die 10 so as to form the mold 11, by drawing said dies close together the material is highly compressed whereas, simultaneously with drawing them together, under the action of a means 12 for controlling and regulating its passage, the excess material is allowed to escape partially outwardly of the mold 11 and, in a second stage, substantially before obtaining the desired dimension between the two faces 2, 3 of block 1 through the relative drawing together of dies 9, 10, the passage of the material escaping outwardly of mold 11 is stopped, according to the invention, after compression of the material, a new manufacturing cycle may be begun again as required.

Although it has not been mentioned, mold 11 comprises at least one imprint 19 for forming at least one block 1 and, preferably, it comprises several imprints 19.

For forming this type of block, a press 20 is used which comprises fixed on its frame 21, a substantially horizontal table 22 whose upper face forms the surface 14 which closes the bottom 15 of the lower die 9.

On table 22 rests a frame 16 in which at least one cut-out 23 defines the internal side walls 17 which will form the peripheral wall of block 1.

The cores 13 project above surface 14 into the zone defined by the frame 16.

These cores 13 are retractable under surface 14 and for that they are connected to at least one means 24 providing a translational movement.

Frame 16 is also secured to a translational moving means 25 by which it can be applied against table 22 or moved away therefrom at least sufficiently for removing a block 1 after it has been placed on a stripping plate 18.

The upper die 10 is formed from a plate 26 whose face 27 opposite table 22 is shaped so as to form the face 2 of block 1 equipped with bosses 7.

The upper die 10 at least locally has dimensions such that, under the action of a translational moving means 28 itself connected to the upper die 10, may close this upper die 10 and more particularly slide inside frame 16, on the one hand for compressing the material and, on the other, for driving out block 1 onto the stripping plate 18 in another manufacturing phase.

In the invention, mold 11 is equipped with a means 12 for controlling and regulating the escape of an excess of material contained in this mold 11 during the compression phase.

In accordance with the invention, means 12 comprises at least one orifice 29 opening inside the mold 11 and whose dimensions are at least sufficient for allowing said material to pass and, on the other hand, a means 30 for closing this orifice 29 under the control of a moving means 31.

According to the invention, on the one hand, orifice 29 formed in mold 11 is situated substantially in the extension of a cavity 32 intended to form on block 1 a complementary projecting means 4 and, on the other hand, the means 30 for closing this orifice 29 closes it substantially at the top of said complementary means 4.

In the preferred embodiment, frame 21 of press 20 is formed mainly by a gantry 33.

It will be noted that frame 16 is secured to an assembly of at least two substantially vertical columns 34 and 35 connected together and situated substantially on each side of this frame and extending substantially over the whole height of gantry 33.

It will be further noted that these columns 34, 35 are movable in translation along their axis and are each guided in this translational movement.

The translational guide means shown as a whole at 36 are substantially situated at the level of each of the ends of columns 34, 35.

It will be noted that these columns 34, 35 are joined together by a substantially horizontal beam 37.

Beam 37 is connected to frame 21 by a translational drive means which forms means 25 for moving frame 16.

This means 25 is formed for example by at least one actuating cylinder.

Plate 26 forming the upper die has advantageously passing therethrough the two columns 34, 35 and comprises elements 38 for guiding it in its translational movement on these columns 34, 35.

It will be noted that the means 28 providing translational movement of plate 26 is formed for example by at least one double acting cylinder placed between beam 37 and said plate 26.

The means 30 are associated as a whole with a plate 40 through which the two columns 34 and 35 also pass and which is guided in translation thereon by means shown as a whole at 41.

The means 31 for moving members 30 is for example a double acting cylinder attached to plate 40.

It will be noted that all the translationally movable elements of the press are advantageously guided on the same columns 34, 35 which allows perfect positioning of the mobile elements to be obtained with respect to each other.

The cores 13 which pass through table 22 are fixed to a plate 42 movable in translation under the action of a drive means 24 which is for example a double acting cylinder connected to frame 21.

In a preferred embodiment, the upper die 10 is equipped with at least one means capable of generating vibrations (not shown).

It will be noted that the devices which feed the mold with material and remove constructional blocks from the mold are only partially described.

These devices as well moreover as the one for controlling the movement of the cylinders and/or making the operation of the press automatic are within the scope of a man skilled in the art.

With this press, after compression of the material:

the cores 13 forming the complementary recessed means are retracted under the substantially horizontal surface 14 forming the bottom 15 of the lower die 9, the upper die 10, the means 12 for controlling and regulating the escape of the excess material, the frame 16 forming the internal side walls of the lower die 9, and the block held between said side walls 17 are simultaneously raised over a height H at least greater than the total thickness of block 1 so that then, a stripping plate 18 is brought substantially under the above mentioned assembly 10, 12, 9, 1, the block 1 is deposited on the stripping plate 18 by driving it out of frame 16 with the upper die 10 which is lowered through said frame until it disengages this block, the stripping plate is removed and with it the block 1, the lower die 9 is reformed by replacing frame 16 on the surface 14 forming the bottom of the lower die and by erecting the cores 13 above the surface 14, a new manufacturing cycle is begun again as required.

We claim:

1. Apparatus for fabrication of construction blocks comprising a mold formed of a lower die whose bottom is closed by a substantially flat surface from which cores are caused to project, and whose side walls are formed by a frame held against a surface, an upper die adapted for sliding inside a frame, means for highly compressing a predetermined amount of material in the plastic state contained in the lower die by means of the upper die, said means being characterized in that, the mold is equipped with a means for controlling and regulating the escape of an excess of material contained in the mold during the compression phase, further characterized in that the controlling and regulating means comprises, an orifice opening inside the mold and having dimensions at least sufficient for allowing the material to pass therethrough and a means for closing this orifice under the control of a moving means.

2. Apparatus according to claim 3, characterized in that the orifice formed in the mold is situated substantially in the extension of a cavity intended to form on the block a complementary projecting means and the means for closing said orifice closing it substantially at the top of said complementary projecting means.

3. Apparatus according to claim 1 characterized in that the press equipped with the mold comprises:

a frame bearing the table supporting said mold, an assembly of at least two columns joined together by a beam, which assembly is movable in translation relatively to the frame of the press, in a direction substantially orthogonal to said table under the action of at least one translational moving means, a frame fixed to said column assembly forming the lower die coming into contact with said table, a plate, guided in translation on at least one of the columns, forming the upper die which plate is controlled in translation relatively to the lower die and so to the columns by at least one moving means, a further plate, guided in translation on at least one of the columns which supports the assembly of members controlling the openings of the upper die, said further plate being movable in translation relatively to the plate of the upper die by at least one moving means.

* * * * *